United States Patent [19]

Jasper, Jr.

[11] Patent Number: 4,820,688

[45] Date of Patent: Apr. 11, 1989

[54] TRAVELING WAVE TUBE OSCILLATOR/AMPLIFIER WITH SUPERCONDUCTING RF CIRCUIT

[76] Inventor: Louis J. Jasper, Jr., 16 Wooley Way, Ocean, N.J. 07712

[21] Appl. No.: 126,080

[22] Filed: Nov. 27, 1987

[51] Int. Cl.[4] ..... H01J 25/42; H01J 25/44

[52] U.S. Cl. ..... 505/855; 315/3.5; 315/3.6; 315/39.3; 330/43; 330/44; 331/82; 331/86; 505/1; 505/826; 505/866; 505/853

[58] Field of Search ..... 315/3.5, 3.6, 39.3; 331/81, 82, 86; 505/1, 826, 853, 855, 866; 330/43, 44

[56] References Cited

U.S. PATENT DOCUMENTS 4,347,419 8/1982 Jasper, Jr. ..... 315/3.5 X

OTHER PUBLICATIONS

"Superconductivity–A Revolution Beckons Microelectronics" Microwaves & R. F., Jul. 1987, pp. 35–42.

New York Times, Mar. 20, 87, "Discoveries Bring a 'Woodstock' for Physics".

Electronics, Apr. 2, 87, "Superconductivity Drive Gets Hotter Every Day".

Physics Today, Apr. '87, "Superconductivity Seen Above the Boiling Point of Nitrogen".

Physical Abstracts, p. 13, vol. 18, No. 8, Apr. 15, 1987.

Physical Review Letters, pp. 1676–1679, Apr. 20, 1987, vol. 58, No. 16.

Physical Review Letters, pp. 2684–2686, 22 Jun. 1987, vol. 58, No. 25.

Asbury Park Press, May 3,1987, "IBM Scientists Now 'Spray-Painting' High-Temperature Superconductors".

IEEE Transactions on Electron Devices, vol. ED. 24, No. 1, Jan. 1977, pp. 13–21, "Broad-Band Injected-Beam Crossed-Field Amplifiers" Traveling-Wave Tubes by J. R. Pierce–1950 Edition.

"Space-Charge Waves and Slow Electromagnetic Waves" by A. H. W. Beck 1958 Edition.

*Primary Examiner*—David K. Moore

*Assistant Examiner*—Mark R. Powell

*Attorney, Agent, or Firm*—Sheldon Kanars; John T. Rehberg

[57] ABSTRACT

Microwave oscillators and amplifiers which utilize a superconducting slow-wave circuit. The slow circuit is made from materials which exhibit superconductivity at relatively high critical temperatures. The slow wave circuit is integral with the device's vacuum housing. Coolant exterior to the vacuum housing maintains the circuit in the superconducting state. The slow-wave circuit, which protrudes into the vacuum housing provides modulation of an electron beam which traverses the interior of the vacuum housing. Output power is ultimately extracted from the slow wave circuit.

17 Claims, 9 Drawing Sheets

TRAVELING WAVE TUBE OSCILLATOR/AMPLIFIER WITH SUPERCONDUCTING RF CIRCUIT

The invention described herein may be manufactured, used, and licensed by or for the Government for governmental purposes without the payment of any royalties thereon or therefor.

TECHNICAL FIELD

This invention relates generally to microwave power tubes and more particularly to traveling wave tubes and crossed field amplifiers which utilize superconducting slow wave circuits.

BACKGROUND OF THE INVENTION

The average power output of typical microwave power devices is limited by the inability of such devices to adequately dissipate heat which is generated by the high currents within such devices. For example, in a typical prior art traveling wave tube, a metal helix is concentrically supported within an elongated, evacuated ceramic or metal cylinder. The helix is usually supported by dielectric rods which maintain alignment of the helix within the cylinder and serve to transfer heat to the cylinder walls and thence to the outside environment. The principal heat transfer mechanism is by conduction through the dielectric supports. However, even with the use of exotic dielectric materials with large heat conductivity, such as diamond or beryllia (beryllium oxide), there are limitations upon the amount of heat that may be carried away from the helix. Such limitations, of course, place restrictions upon operation of the tube—particularly upon the amount of current which the helix can tolerate. Furthermore, it is impossible to obtain perfect contact at the helix-rod and rod-cylinder interfaces. Prior art attempts at improving contact at these interfaces involve metallizing the helix-rod interface together with heat shrinking techniques to press-fit the rods against the inside surfaces of the cylinder. Nevertheless, heat transfer is still limited because the helix only touches a particular rod at one point per turn. Backward wave oscillators and crossed field amplifiers which also use helical slow wave circuits exhibit the same problems and have endured similar attempts at solution.

U.S. Pat. No. 4,347,419, entitled "Traveling Wave Tube Utilizing Vacuum Housing As An RF Circuit", issued to the present inventor, discloses a traveling-wave-tube with a cylinder that serves as a vacuum housing and also has an integral helical slow wave circuit. The helix conductor is intertwined with and hermetically sealed to the material which comprises the vacuum housing. Thus, heat may be readily transferred from the inside of the housing to the outside of the housing since the helix is not supported by dielectric rods but is instead an integral part of the vacuum housing. The helix is typically made from copper or other conductive material. However, although copper nd other metals such as silver or tungsten may be good or even excellent conductors of both heat and electricity, they do nevertheless exhibit demonstrable losses.

Recent developments in the field of superconductivity have produced a large variety of new ceramic-type materials which are capable of achieving the superconducting state at critical temperatures above 77° K., the boiling point of liquid nitrogen. The critical temperature is the temperature at which the material becomes superconducting. The new class of materials (termed for convenience, "superconducting ceramics" herein—even for materials which are not basically ceramic in nature) has been extensively discussed in the popular press. For example, the *New York Times,* on Mar. 20, 1987 reported the existence of superconducting ceramics and described the making of such materials into sheets of vinyl-like tape and washer shapes. Furthermore, *Electronics* in its Apr. 2, 1987 issue on pp. 49–51 reported the making of superconducting ceramics into wire shapes.

The composition and manufacture of superconducting ceramics is discussed, for example, in *Physics Today,* pp. 17–23, April 1987, which is incorporated herein by reference. An entire class of compounds with the chemical composition is $RBa_2Cu_3O_{9-y}$, where R stands for a transition metal or a rare earth ion and y is a number less than 9, preferably $2.1 \pm 0.05$, has demonstrated superconductive properties above 90° K. This class of materials is included in the terms "superconducting ceramic" and "rare-earth doped copper oxide" as used herein. Scandium, lanthanum, neodymium, samarium, europium, gadolinium, dysprosium, holmium, erbium, ytterbium, yttrium, and lutetium are acceptable substitutes for R above. The crystal structure of these compounds is described as an orthorhombically distorted perovskite structure.

Some compounds are formulated substituting strontium for barium. For example, $La_{2-\chi}SR_{\chi}CUO_{4-\chi}$ has exhibited superconductivity at high temperatures, as reported in *Physical Review Abstracts,* p.13, vol. 18, No. 8, Apr. 15, 1987.

Fabrication of superconducting ceramics is discussed in the above-mentioned *Physics Today* article. A detailed discussion of the fabrication and physical properties of a typical superconducting ceramic is also found in: R. J. Cava et al., Bulk Superconductivity at 91° K. in Single Phase Oxygen - Deficient Perovskite $Ba_2YCu_3O_{9-\delta}$, *Physics Review Letters,* pp. 1676–1679, April 20, vol. 58, number 16.

Superconducting ceramics with high critical current densities may be (in excess of $10^5 A/cm^2$) produced by growing epitaxial films of $RBa_2Cu_3O_{7-\chi}$ on $SrTiO_3$ substrates as taught in P. Chaudhari et al., "Critical Current Measurements in Epitaxial Films of $YBa_2Cu_3O_{7-\chi}$ Compound," Phys. Rev. Ltrs. vol 58, no 25, pp. 2684–2686, 22 June 1987.

It has been further been determined that superconducting ceramics may be formed by plasma-spraying techniques, such as those described in the aforementioned U.S. Pat. No. 4,747,419.

In addition, it has been determined that semiconductor fabrication techniques such as laser ablation, electron beam epitaxy, sputtering, ion implantation and plasma spraying may be used to form superconducting ceramics.

The Asbury Park Press on May 3, 1987, reported that scientists have developed plasma spraying techniques to coat items—including tubes made from ceramic, quartz and metals of various sizes—with superconducting ceramic coatings. Plasma spraying is a technique in which a material (in this case a superconducting ceramic) is heated to a high temperature and then deposited on a cool surface where it solidifies. After coating, the objects are subsequently annealed.

Furthermore, ion implantation techniques have been developed for fabricating side-by-side layers of superconducting and non-superconducting materials.

Those concerned with the development of microwave power devices have continuously sought methods and apparatus for improving the performance of such devices and for reducing the resistive losses (and consequent heat dissipation problems) inherent in slow-wave structures. Furthermore, those concerned with the development of superconducting ceramics have engaged in a continuing search for new application for these materials.

SUMMARY OF THE INVENTION

It is an object of the present invention to provide a microwave device that is relatively simple and inexpensive to manufacture yet which is free from many of the power limitations of conventional devices.

It is another object of the present invention to provide a microwave device with improved RF gain, RF power, efficiency, and bandwidth.

A further object of the present invention is to provide a microwave device with a superconducting slow-wave circuit.

Still another object of the present invention is to provide a traveling wave tube with a superconducting slow wave circuit integral with a vacuum housing.

Yet another object of the present invention is to provide a backward wave oscillator with a superconducting slow wave circuit integral with a vacuum housing.

An additional object of the present invention is to provide a crossed field amplifier with a superconducting slow wave circuit integral with a vacuum housing.

The present invention is a microwave device with a vacuum housing having an integral superconducting slow-wave circuit. The slow-wave circuit is a superconducting ceramic material which is intertwined with and an integral part of the vacuum housing. Outside the vacuum housing is a bath of liquid nitrogen, or other coolant capable of maintaining the slow-wave circuit in the superconducting state. The coolant permits the slow wave circuit to dissipate heat generated by the electron beam while simultaneously maintaining the circuit in its superconducting (i.e. resistanceless) state. Inside the vacuum housing, the slow-wave circuit serves to modulate the electron beam. A variety of slow-wave circuits are discussed and their applications to traveling-wave-tubes, backward wave oscillators and crossed-field amplifiers are disclosed.

BRIEF DESCRIPTIONS OF THE DRAWINGS

Further objects and advantages of the present invention will become apparent to those familiar with the art upon examination of the following detailed description and accompanying drawings in which.

.

DETAILED DESCRIPTION OF THE PREFERRED EMBODIMENTS

Figure 1:
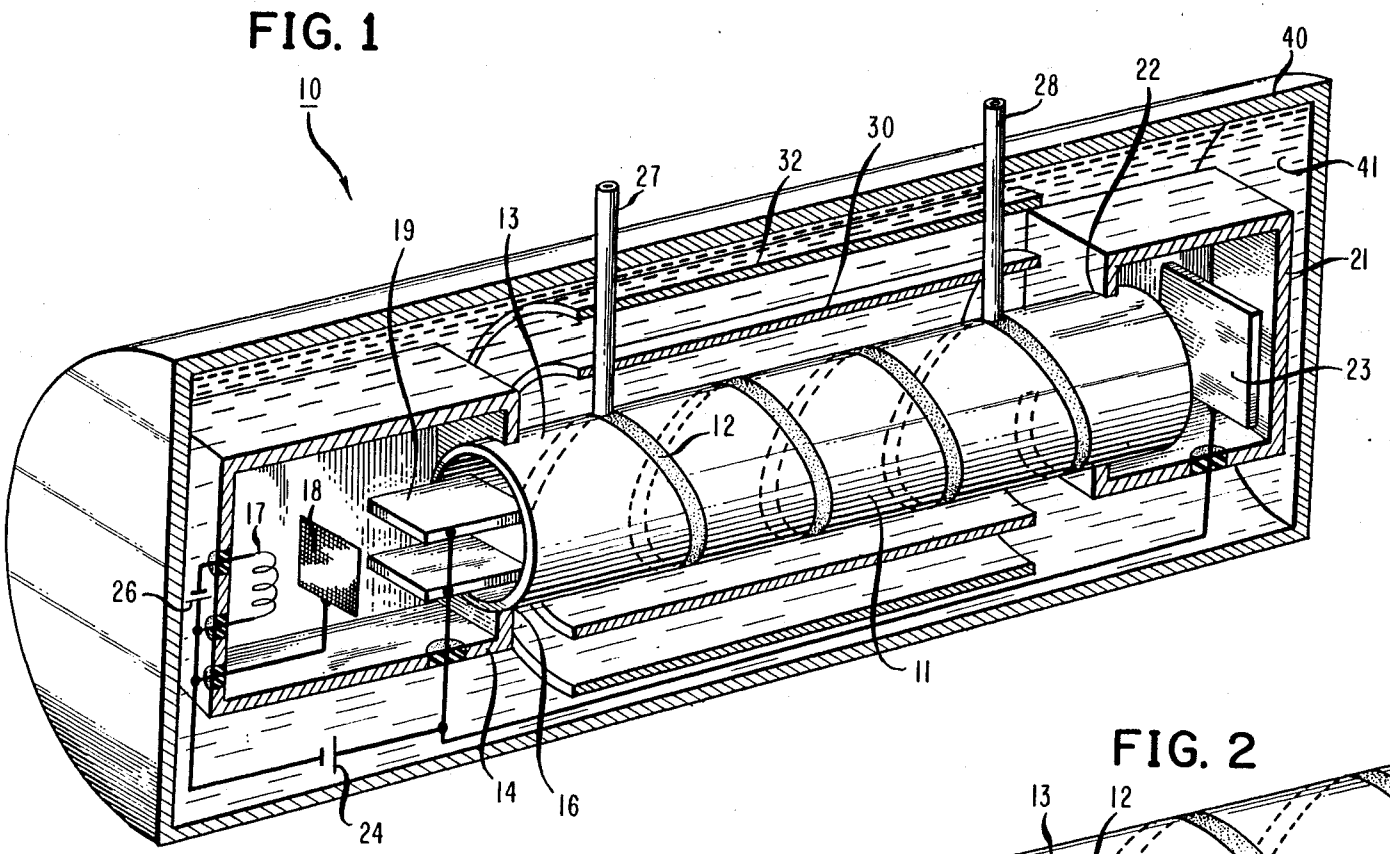
FIG. 1 is a partially schematic, partially cross sectional view of a traveling wave tube according to the present invention.

Referring to the drawings, wherein like numerals refer to like components throughout, and particularly to FIG. 1, reference numeral 10 designates generally an inventive device. An elongated cylindrical vacuum housing 11 contains a helix 12 of superconducting ceramic material intertwined and fused to non-superconducting dielectric ceramic material 13. End cap 14 is hermetically sealed at junction 16 to one end of housing 11. Cap 14 contains a heater 17, cathode 18, and a gun anode 19. A second end cap 21, hermetically sealed at junction 22, to the other end of housing 11, includes a collector 23. Collector 23 is shown in FIG. 1 schematically as a separate component, but it may be integral with end cap 21. Both end cap 21 and collector 23 may be made of superconducting ceramic, if desired, although metal is also acceptable. Both collector 23 and anode 19 are connected to the positive terminal of a first voltage source 24. The negative terminal of voltage source 24 connects to cathode 18 and to the positive terminal of a second voltage source 26 for heater 17. It is sometimes more convenient to operate cathode 18 below ground potential while helix, anode and collector are at ground potential. For depressed collector operation, to recover unused energy in the electron beam, another voltage source is required between collector 23 and helix 13 at a reverse voltage. This arrangement puts the collector below ground potential and approaching the cathode potential.

When the voltage source 24 is energized, an electron beam is generated and electrons flow from cathode 18 to collector 23 in accordance with well known physical principles. For thermionic cathode operation, cathode 18 is either directly heated to a temperature greater than 850° C. or indirectly heated by heater 17 (as shown in FIG. 1) which has one leg connected together with cathode 18 to the positive terminal of voltage source 26.

The electron gun shown schematically in FIG. 1 (enclosed within cap 14) operates by thermionic emission. Other electron gun designs well know to those skilled in the art such as those which operate by field effect emission (utilizing a high voltage applied to the cathode) or cold cathode emission (utilizing special cathode materials) may be substituted for the electron gun of FIG. 1. Cold cathodes are particularly applicable to crossed field amplifiers which will be discussed subsequently. An advantage of cold cathode operation is that less heat is generated within cap 14. Consequently, there is less danger of raising the temperature of superconducting components and destroying the superconductive effect. Field emission cathodes have primary use for expendable jammers and high frequency (millimeter spectrum) operation where operating life may be short and where small surface area cathodes may be used.

Cylinder 30, concentric with vacuum housing 11 may be used to provide a ground reference. Permanent magnet structure 32 is positioned concentric with vacuum housing 11. Examples of suitable permanent magnet structures are contained in copending U.S. applications entitled "Parametic Linear Variation of a Leakage Free-Permanent Magnet Field," Ser. No. 868,862, filed 30 May 1986, now U.S. Pat. No. 4,692,732, and "A Leakage-Free, Linearly Varying Axial Permanent Magnet Field Source," Ser. No. 868,863, filed 30 May 1986, now U.S. Pat. No. 4,701,737 both of which applications are hereby incorporated by reference. Also, periodic permanent magnet (ppm) structures may be utilized to focus the electron beam. The ppm structure is well-known to those skilled in the art and is a commonly used magnetic structure.

In operation, microwave energy is fed into coaxial input coupler 27 which is attached to helix 12 near cap 14. RF energy, amplified by interaction with the electron beam traversing the tube from anode 19 to collector 23, is extracted via coaxial RF coupler 28. Coupler 28 is connected to helix 12 at the downstream end of the tube near collector 23. Couplers 27 and 28 need not protrude into vacuum housing 11. However, both couplers 27 and 28 must be in good electrical contact with helix 12. Also both couplers must have their outer shields in good electrical contact with grounding cylinder 30.

Figure 2:
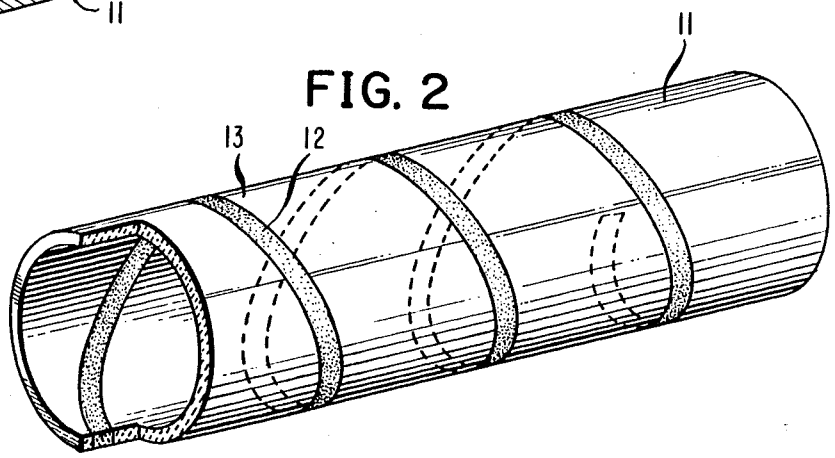
FIG. 2 is a partially cut away view of a portion of the vacuum housing of the traveling wave tube shown in FIG. 1.
Figure 3:
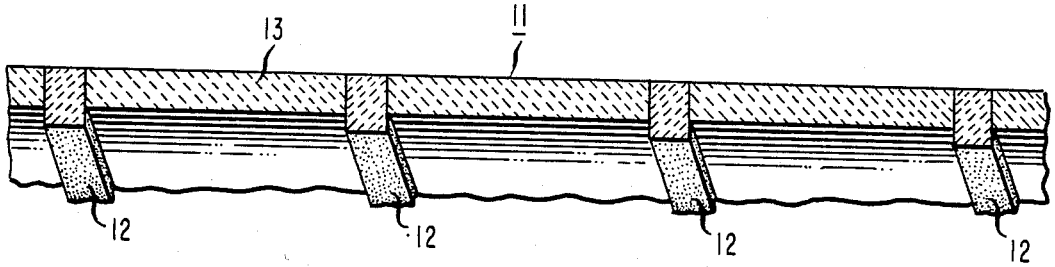
FIG. 3 is a partial cross sectional view of a portion of an alternative embodiment of the vacuum housing shown in FIG. 2.

FIG. 2 illustrates the construction of vacuum housing 11. In particular, it may be noted in FIG. 2 that helix 12 extends from the outside of vacuum housing 11 to the inside. Helix 12 is not merely wound about dielectric 13, but is intertwined with it and fused to it. The arrangement is more clearly shown in FIG. 3, which is a partial cross section of vacuum cylinder 11. FIG. 3 illustrates the manner in which alternate turns of helix 12 are spaced apart and joined to corresponding portions of an intertwined dielectric helix 13 to form a unitary hermetically sealed structure 11. In FIG. 3, it will be noted that the turns of helix 12 extend radially inward to a greater depth than the corresponding portions of the dielectric helix 12. The radial inward extension serves to concentrate the RF fields at the innermost surfaces of the helix so that the fields will be more intense near the electron beam.

Figure 4:
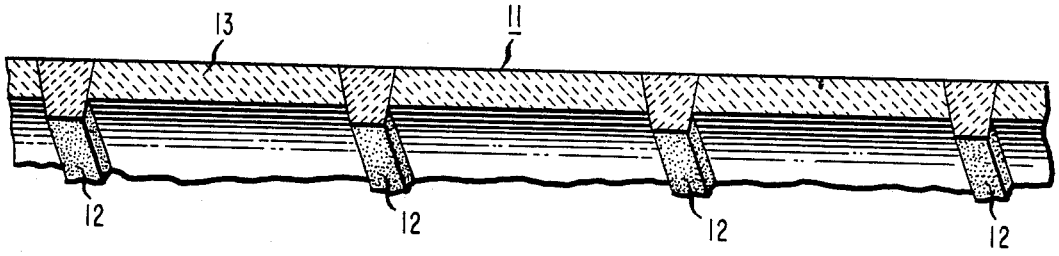
FIG. 4 is another partial cross sectional view showing an alternate embodiment of the vacuum housing shown in FIG. 2.

FIG. 4 is an alternative partial cross section of housing 11. In FIG. 4 the cross section of the superconducting ceramic helix is somewhat wedge-shaped. The wedge-shaped helix serves to further reduce RF loss, to concentrate electric fields near the electron beam, and also to improve vacuum integrity. Helix 12 is made from superconducting ceramic material Dielectric 13 is made from nonconducting material. The method of fabricating and fusing the two materials together will be discussed in later paragraphs.

Returning to FIG. 1, container 40 is filled with a supply of liquid nitrogen 41 or other coolant capable of maintaining superconducting ceramic helix 12 below its critical temperature. Coolant 41 thus serves not only to dissipate heat produced by the device, but also to maintain the superconducting properties of helix 12.

Thus, the present inventive device provides the following advantages:

(a) higher peak and average power are achievable, since both helix and collector are superconducting and exposed directly to the coolant reservoir;

(b) RF couplers 27 and 28 need not extend through vacuum housing 11, and RF energy can be coupled directly to helix 12;

(c) various methods and techniques formerly used to vary the dispersion characteristics of the helix may now be used more simply and more cheaply. Examples are: axial vane loading, variable vane loading, electronic programming of jamming, dual mode operation, and sophisticated attenuation techniques to eliminate unwanted modes;

(d) the expense of manufacturing the device is reduced;

(e) larger bandwidth, higher RF gain and improved efficiency are obtained.

The superconducting helix and collector serve to not only radiate heat generated from their outer surfaces, but also serve as conduits to transmit excess heat generated within them.

Figure 11:
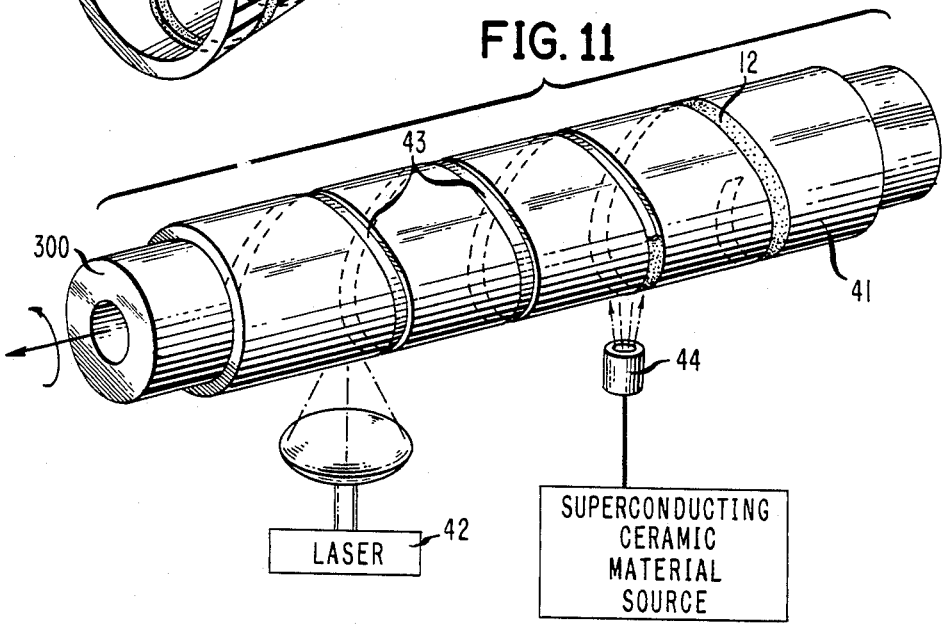
FIGS. 11 and 12 are diagrams illustrating methods of forming the vacuum housing illustrated in FIGS. 2–10.
Figure 12:
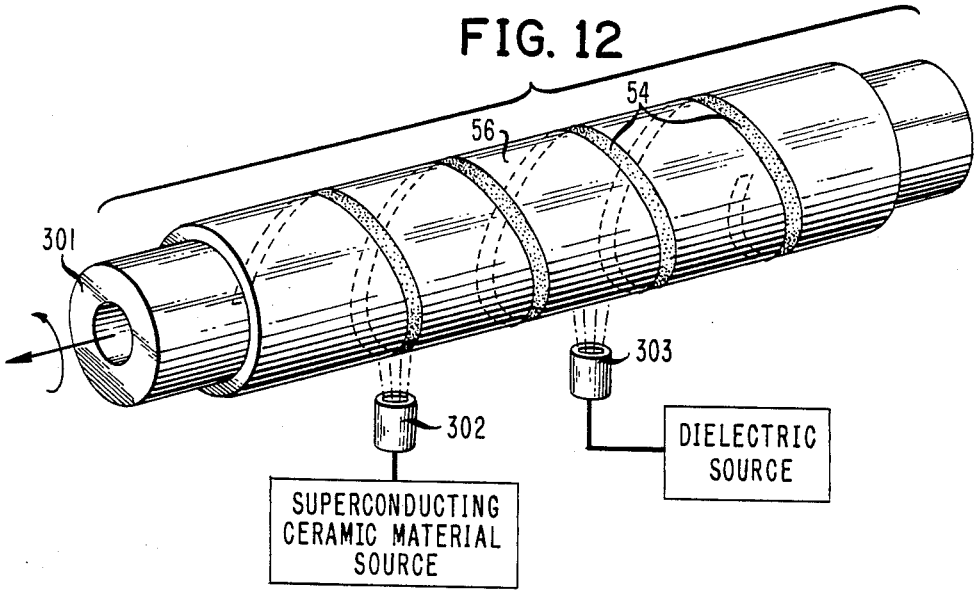

Let us now consider the manner in which the vacuum housing shown in FIGS. 1–4 may be manufactured. FIGS. 11 and 12 illustrate two possible manufacturing techniques. Both techniques utilize plasma spraying. Plasma spraying is a technique which quickly heats a material to thousands of degrees and instantly deposits the material on a surface where it resolidifies. As mentioned before, superconducting ceramics are rare-earth doped copper oxides. For example, one superconducting material is a combination of yttrium, barium and copper oxides. The dielectric part 13 of the vacuum housing 11 may be made of a material akin to a superconducting ceramic with the percentage of one or more of the constituent changed to render the resulting compound non-superconducting at temperatures of coolant 41 and higher. For example, the concentration of yttrium or barium might be varied.

In any event, the material used for dielectric portion 13 must be a good insulator, have low vacuum outgassing properties, low-loss at microwave frequencies, and have the same or very nearly the same coefficient of thermal expansion as the superconducting ceramic. The same or nearly the same coefficient of thermal expansion is important for all portions of vacuum housing 11 so that vacuum integrity may be maintained over a range of temperatures. Other candidate dielectric materials are boron nitride, alumina, beryllia, etc. The insulating portion 13 of vacuum housing 11 may be made by plasma spraying a dielectric coating made from one of the aforementioned materials over a cylindrical mandrel 300 or by otherwise forming an elongated hollow ceramic cylinder 41 by techniques well known in the ceramic art. Then, as illustrated in FIG. 11, utilizing a laser 42, a continuous helical groove 43 is cut through cylinder 41. The groove 43 may be cut into mandrel 300 if the configurations shown in FIGS. 3 and 4 are desired. Next, using a plasma spray gun 44, the superconducting ceramic is sprayed to form helix 12 within helical grooves 43. The superconducting material should cover the entire cylinder for good vacuum quality. Abrasives or chemical etchants may be utilized to remove the excess superconducting ceramic from vacuum cylinder 11 to obtain the desired "barber-pole" appearance. Also, if desired, a superconducting ceramic material might be sprayed on the output end of the cylinder to form a hermetically sealed collector cup. On the input end of the cylinder, an annular ring of metal (16 in FIG. 1) may be plasma sprayed to form a connection point for attachment of an electron gun 14 by brazing or other means. The resulting cylinder may be removed from the mandrel and annealed. Annular ring 16 for the electron gun attachment may be fabricated before or after the annealing process. It is possible to substitute conventional mechanical cutting means for cutting the helical grooves within cylinder 41 as an alternative to laser machining. In addition, a grooved mandrel may also be utilized. The grooved mandrel is subsequently separated from the vacuum housing to obtain the desired hollow cylinder with a superconducting helix extending radially inward from the vacuum wall.

FIG. 12 illustrates an alternative method for the fabrication of the vacuum cylinder. In FIG. 12, mandrel 301 rotates. A pair of plasma guns 52 and 53 deposit respectively superconducting ceramic and dielectric material on the surface of mandrel 301. Mandrel 301 is rotated at a prescribed velocity while simultaneously longitudinally advancing so that plasma guns 302 and 303 respectively lay down intertwined helices of superconducting ceramic and insulating ceramic with predetermined length, width, pitch and thickness. After completion, the mandrel is removed or chemically dissolved.

A third, alternative method of fabricating the vacuum housing is to initially fabricate an entire cylinder of superconducting ceramic. Then, using ion implantation techniques destroy the superconducting attributes of one portion of the cylinder (i.e. reference numeral 13 of FIG. 2) to form intertwine helices.

Figure 5:
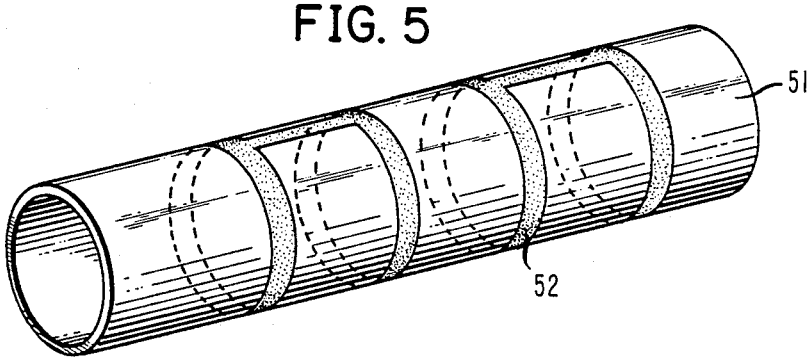
FIGS. 5–10 are perspective views of alternative embodiments of the vacuum housing illustrated in FIGS. 1 and 2.

A variety of other structures may be fabricated using techniques similar to those described in connection with FIGS. 11 and 12. FIGS. 5–10 illustrate alternative vacuum housing structures which may be substituted for the cylindrical housing 11 of FIG. 1. Each of the housings depicted in FIGS. 5–10 contains a superconducting slow wave circuit integral with a ceramic vacuum housing. For example, FIG. 5 illustrates a ring-bar superconducting ceramic slow wave circuit 52 fabricated integral with non-superconducting ceramic vacuum housing 51. It is well known, that the ring-bar circuit is useful in supressing backward-wave oscillations in traveling wave tubes. Consequently, a device utilizing the ring-bar circuit of FIG. 5 may be expected to operate without backward-wave oscillation at higher power levels than a single-helix device with no backward-wave oscillation suppression. Also the ring-bar circuit has a higher impedance than the helical circuit. Its characteristics are higher gain and less bandwidth.

Figure 6:
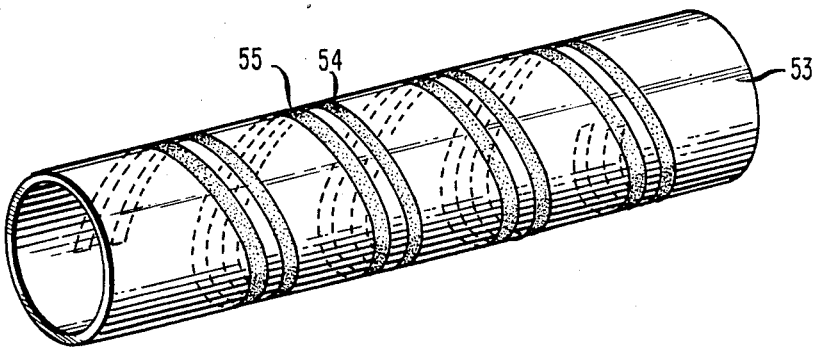

The vacuum housing of FIG. 6 may also be used as an alternative to vacuum housing 11 of FIG. 1. In FIG. 6, vacuum housing 53 has two integral concentrically wound helices 55 and 54 intertwined. In operation, helices 55 and 54 are excited in an out-of-phase manner (by 180°) to create transverse wave interactions with the electron beam. Transverse wave devices are exploited for high efficiency since depressed collector schemes can recover more of the energy of the spent electron beam.

Figure 7:
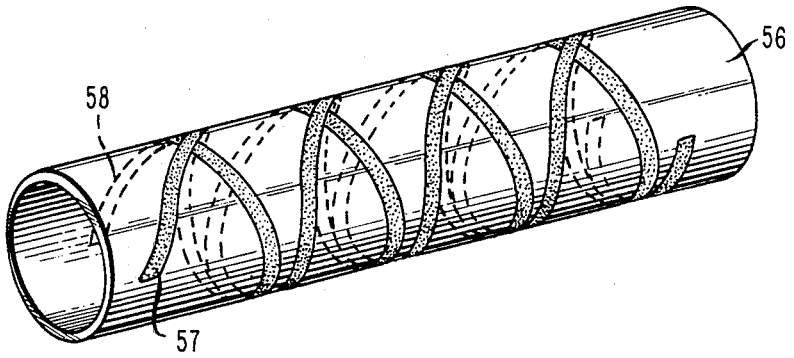
Figure 8:
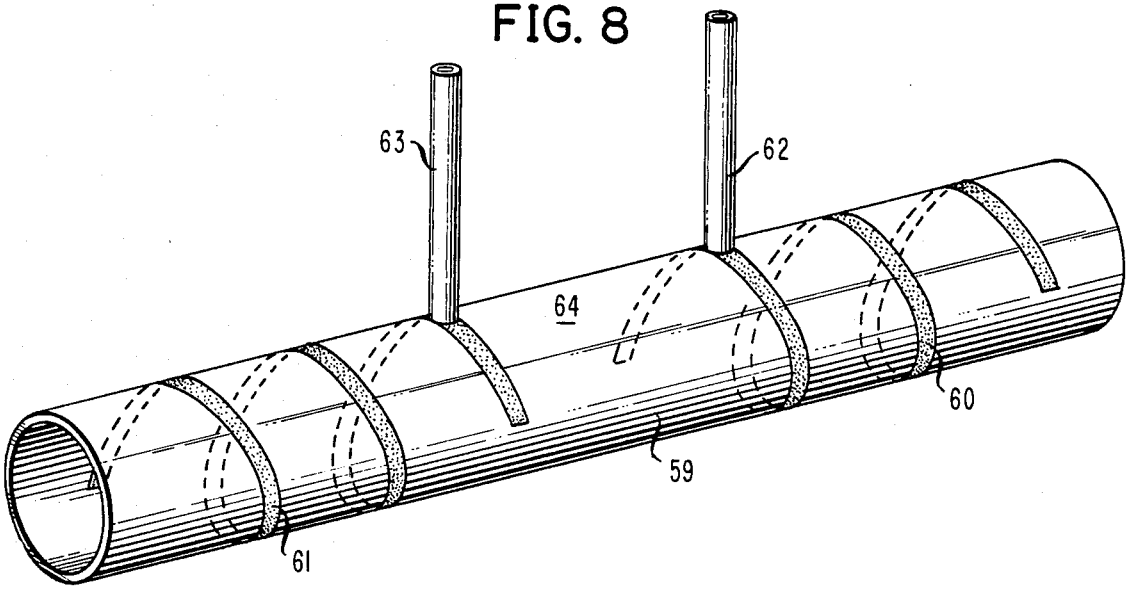

FIG. 7 illustrates vacuum housing 56 with two contrawound helices 57 and 58, termed a "bifilar" helix. The bifilar helix structure tends to suppress backward-wave oscillations and permit higher operating voltages, currents, and RF power levels than are possible with a single helix (with no suppression techniques being used). It may be necessary to position a layer of insulation between the two helices at the points where they touch The vacuum housing of FIG. 8 is, however, fabricated to specifically encourage backward-wave oscillation. Vacuum housing 59 has two separate integral helices 60 and 61. A small portion of housing 59 (termed the "drift region") (designated in FIG. 8 by reference number 64) is not covered by either helix. RF connections 62 and 63 to helices 60 and 61 respectively are made near the center of vacuum housing 59, near region 64 which is not covered by any helix The vacuum housing of FIG. 8 may be substituted for housing 11 of FIG. 1. Ipput RF energy is coupled to RF connector 63 and thence to helix 61. The electron beam traveling from electron gun 14 to collector 23 is modulated by the signal on helix 61. The modulated electron beam creates an amplified signal upon helix 60. The amplified signal is transmitted to RF connector 62 at the device output.

Figure 9:
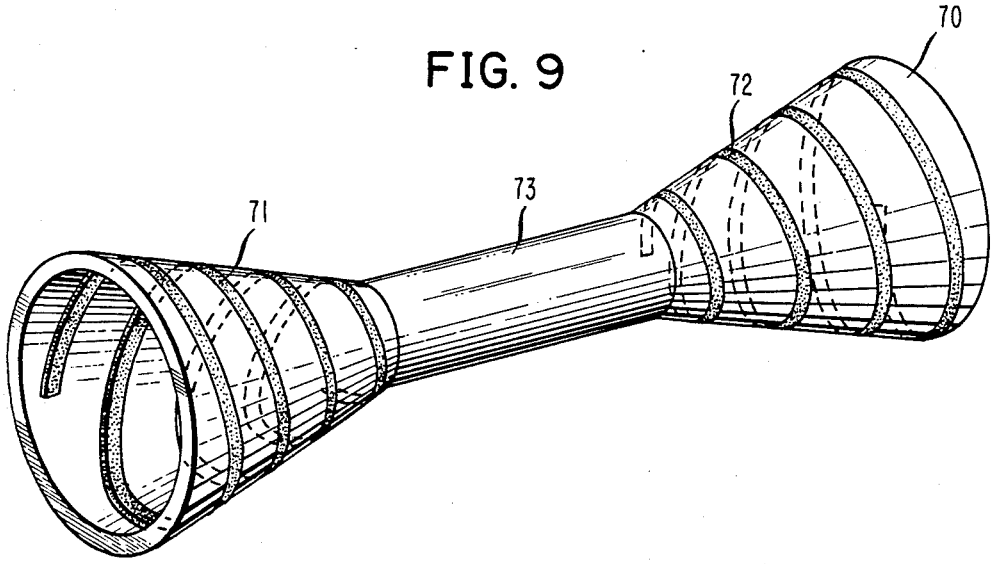
Figure 10:
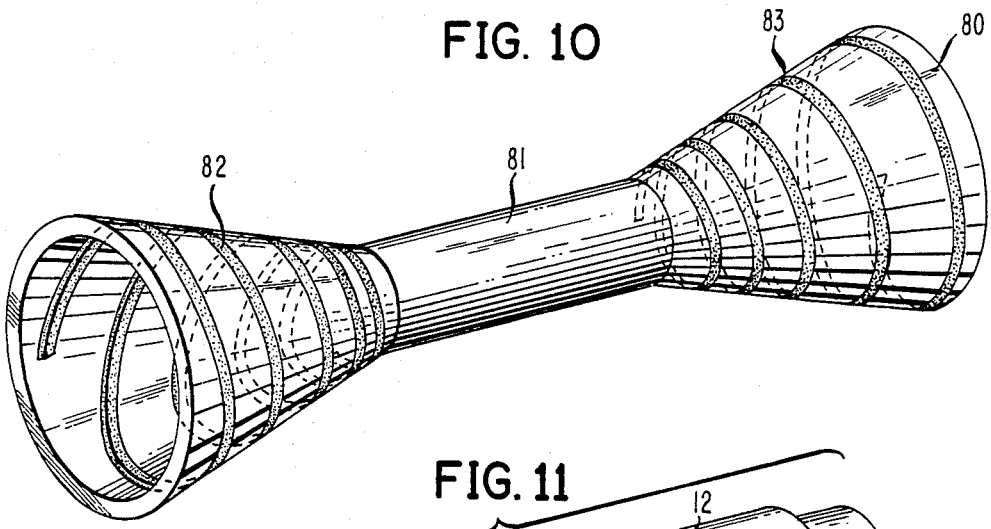

The device of FIG. 9 is a vacuum housing 70 with two integral superconducting ceramic helices 71 and 72 at its extreme ends. Drift region 73 is located in the middle of vacuum housing 70. Drift region 73 does not contain any helices. The conical shapes at the ends of vacuum housing 70 provide helices 71 and 72 with gradually increasing diameters. In the embodiment of FIG. 9, the distance between adjacent turns of each helix is equal In the embodiment of FIG. 10, vacuum housing 80 has drift region 81 and two helices 82 and 83 at opposite ends. Vacuum housing 80 has conical shapes at its right and left ends, similar to vacuum housing 70 of FIG. 9. However, the spacing between adjacent turns of helices 82 and 83 and the line widths are log-periodic. Both devices of FIGS. 9 and 10 are useful for extending frequency bandwidth at the compromise of lower gain.

As mentioned before, in each of the embodiments of FIGS. 5–10, the helix or slow-wave circuit is made from superconducting ceramic material, while the balance of the vacuum housing is made from dielectric material. The cross sectional views of FIGS. 3 and 4 are also appropriate to an understanding of the embodiments illustrated in FIGS. 5–10. In each case, it is preferable, though not absolutely essential, that the slow-wave circuit protrude into the interior of the tube in the manner illustrated in FIGS. 3 or 4 to concentrate electric fields within the interior of the vacuum housing and enhance interaction with the electron beam. In the embodiments just discussed, the methods used to attach and fabricate conventional traveling wave tube components such as the electron gun, are not shown in detail. It is apparent to one skilled in the art, that the thickness of the vacuum housing (reference numeral 11 and its equivalents in FIGS. 5–10) must be consistent with the requirement of vacuum integrity, structural strength, power level, and frequency of operation.

Although the discussion so far has concentrated on traveling wave tubes, the principles disclosed are generally applicable to backward wave oscillators. Backward wave oscillators (BWO's), of course, do not have both input and output RF couplers. Instead, a BWO has a single output coupler near the electron gun end of the tube. BWO's often use a ring-shaped cathode to generate a hollow electron beam. The use of a hollow electron beam traveling close to the slow wave structure enhances backward wave interaction. The slow wave structures depicted in FIGS. 2–10 may also be employed in BWO's.

Figure 13:
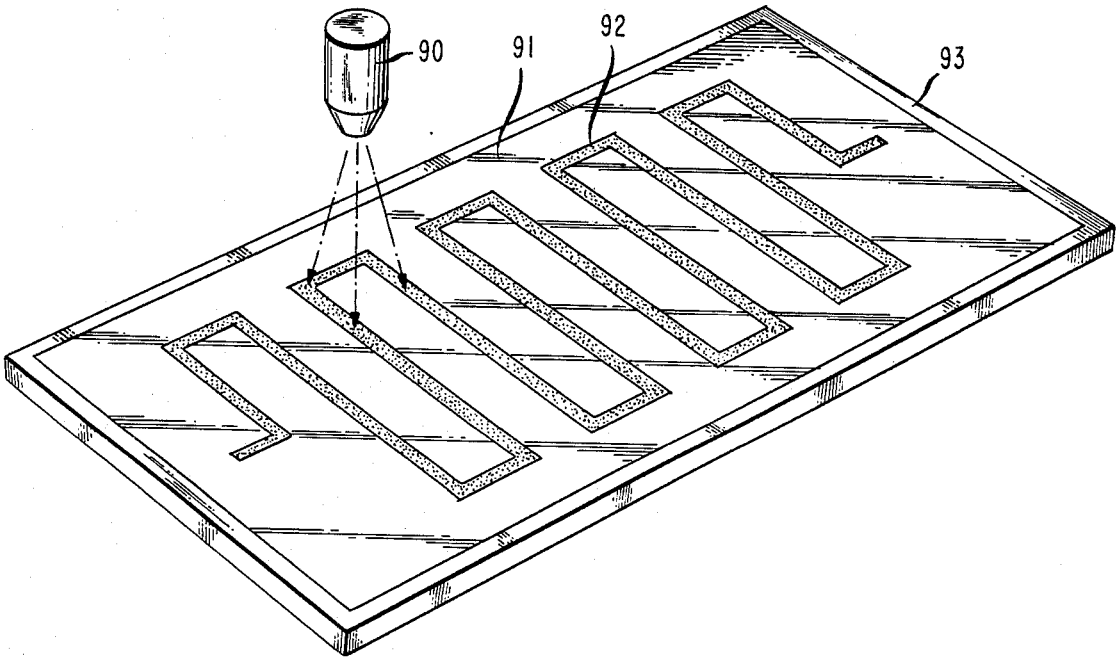
FIG. 13 is a meanderline-structure formed by the teachings of the present invention.
Figure 14:
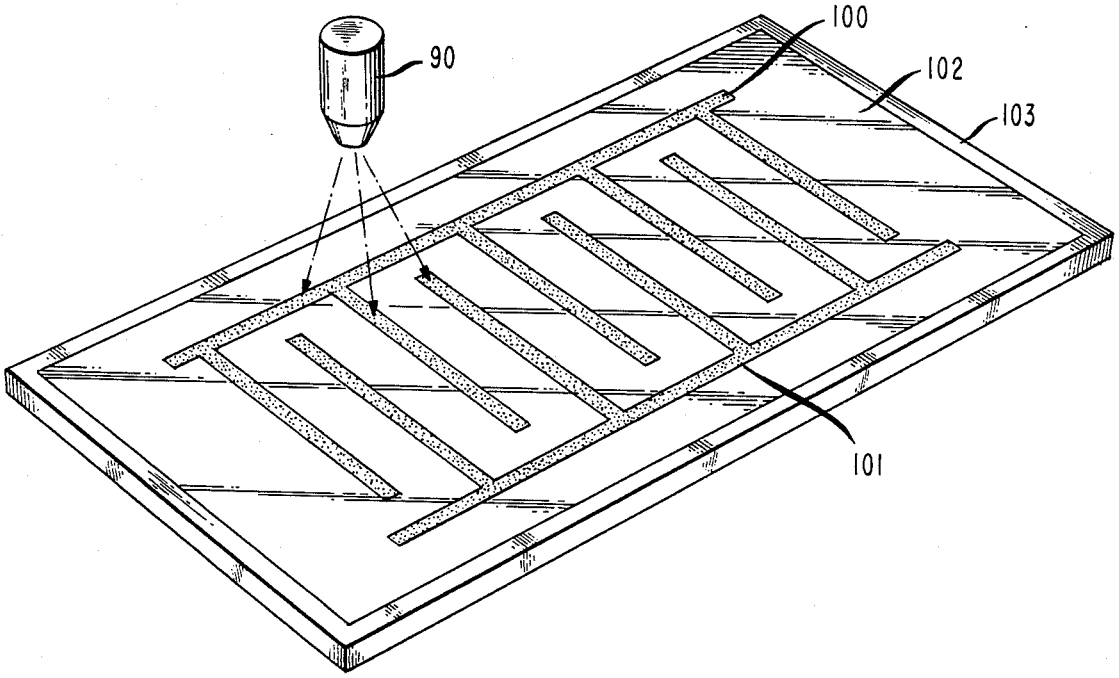
FIG. 14 is an interdigital slow wave circuit according to the present invention.

The present invention also comprehends the use of other slow-wave structures, such as those illustrated in FIGS. 13 and 14. FIG. 13 illustrates a meanderline RF circuit, suitable for use in traveling wave tubes and crossed-field amplifiers. The meanderline of FIG. 13 may be formed in a manner akin to that illustrated in FIGS. 11 and 12. However, of course, in the applications of FIGS. 11 and 12, the mandrel or work piece must rotate. In FIG. 13, the laser cutting or plasma spraying machinery 90 must follow a movement described by translation along one axis followed by a translation along a second orthogonal axis. The laser cutting apparatus is not shown in FIG. 13 for clarity. As mentioned before, the composition of sprayed material may be selectively altered to create a superconducting ceramic meanderline 92 and dielectric substrate 91. The entire structure may be formed within a rim 93 which extends around the periphery of dielectric 91 for vacuum sealing purposes. Rim 93 may be made from metal.

Similarly, the interdigital slow-wave circuit depicted in FIG. 14 may be made utilizing computer-control laser cutting and plasma spraying apparatus. A pair of interdigital superconducting ceramic fingers 100 and 101 is formed by laser cutting the fingers and plasma spraying the ceramic dielectric substrate 102. The method used is the same as depicted in FIGS. 11 and 12 except rotation of the target is not required. Metal rim 103 girdles the entire substrate 102 to facilitate vacuum sealing. Of course, in both FIGS. 13 and 14 the slow wave structures 92, 100 and 101 extend through their respective dielectric substrates.

Figure 16:
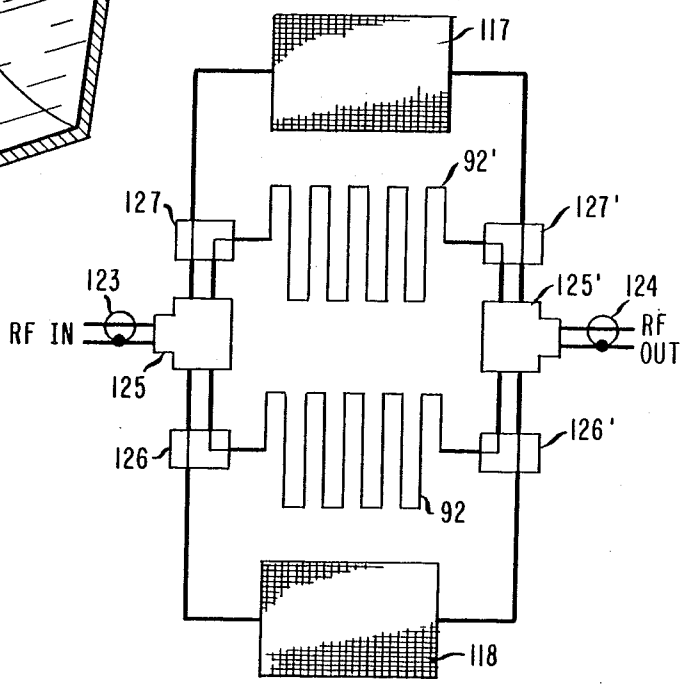
FIG. 16 is a wiring diagram illustrating RF input/output connections to the device of FIG. 15.
Figure 15:
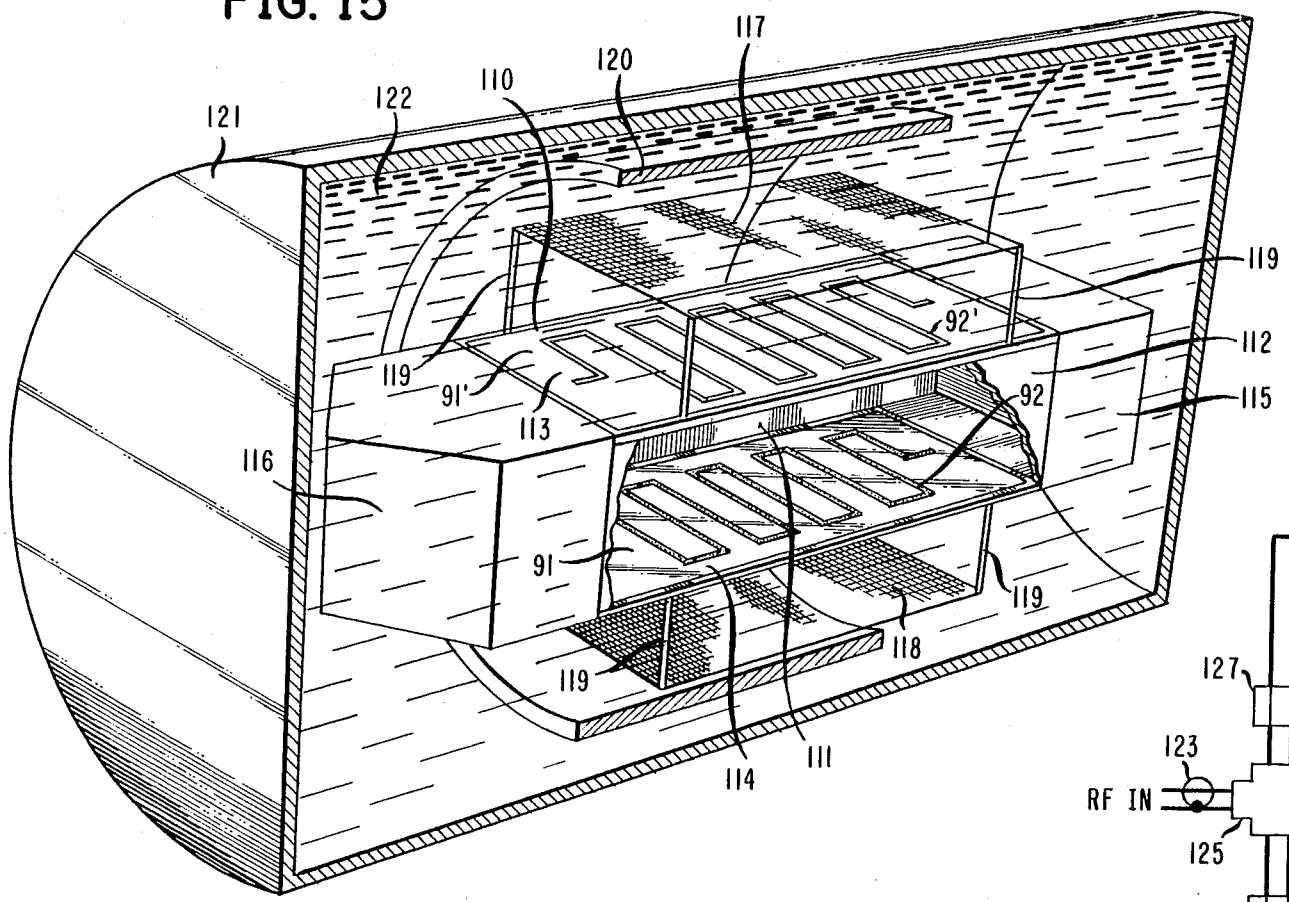
FIG. 15 is a partially schematic, partially cross sectional view of a meanderline-type traveling wave tube according to the present invention.

Incorporation of the meanderline structure illustrated in FIG. 13 into a microwave device is illustrated in FIGS. 15 and 16. In FIG. 15 a vacuum housing is formed utilizing two meanderline sheets similar to that depicted in FIG. 13, positioned one above the other. The resulting structure resembles a box 110. The top and bottom sides of the box 113 and 114 respectively, contain meanderline structures 92′ and 92, while the front and rear sides 111 and 112 are made from dielectric ceramic. Edges of the box may be formed in a vacuum-tight manner by soldering or brazing metal rims akin to metal rim 93 illustrated in FIG. 13. Collector shown schematically as box 115 is positioned at the right end of box 110 and electron gun shown schematically as box 116 is positioned at the left end of box 110. Both collector 115 and electron gun 116 are, of course, secured to box 110 by techniques designed to insure the vacuum integrity of the box. Electrical power connection to electron gun 116 are omitted for simplicity. Similarly, electrically connections to collector 15, (including depressed collector connector), have been omitted in FIG. 15 for clarity. However, details of typical electron gun power connection are well illustrated in FIG. 1. Ground planes 117 and 118, which may be made from metal mesh are supported respectively above and below meanderline 92′ and 92 by dielectric supports 119.

The distance between ground planes 117 and the top 113 of the box 110 containing meanderline structure 92′ is determined by the desired operation frequency. Similarly, the distance between ground plane 118 and the bottom 114 of box 110 is determined by the frequency of operation. These relative distances have been somewhat exaggerated for clarity in FIG. 15. Magnetic focusing structure 120 girdles the entire structure. Although coil-type magnets may be utilized to produce a variety of magnetic field patterns desired by those skilled in the art, there are currently available a wide variety of powerful permanent magnet structures which will perform as well. Examples of such permanent magnet structures have already been mentioned in connection with FIG. 1. Container 121 filled with coolant 122 surrounds the entire aforedescribed structure. Coolant 122 which may be, as mentioned before, liquid nitrogen or other coolant suitable for inducing the superconducting state in meanderline 92 and 92′.

FIG. 16 illustrates the manner of connection for the RF input and output signal from the device illustrated in FIG. 15. Input RF conductor 123, which is typically a coaxial cable extends through container 122 to power divider 125. The input signal is divided equally at power divider 125 to RF connectors 126 and 127. RF connector 127 has its center conductor in good electrical contact with meanderline 92′ and its outer shield connected to ground plane 117. Similarly, RF connector 126 serves to input RF energy to meanderline 92 by means of its center conductor and its outer shield is connected to ground plane 118. The output signal emerging from coaxial cable 124 is the result of signals obtained from RF connectors 126′, 127′, and power divider 125′. The theory of operation of the device in FIGS. 15 and 16 is akin to the theory of operation of the devices already described in FIGS. 1–10. Specifically, interaction of the electron beam with the slow wave circuits 92 and 92′ produces amplification.

Figure 18:
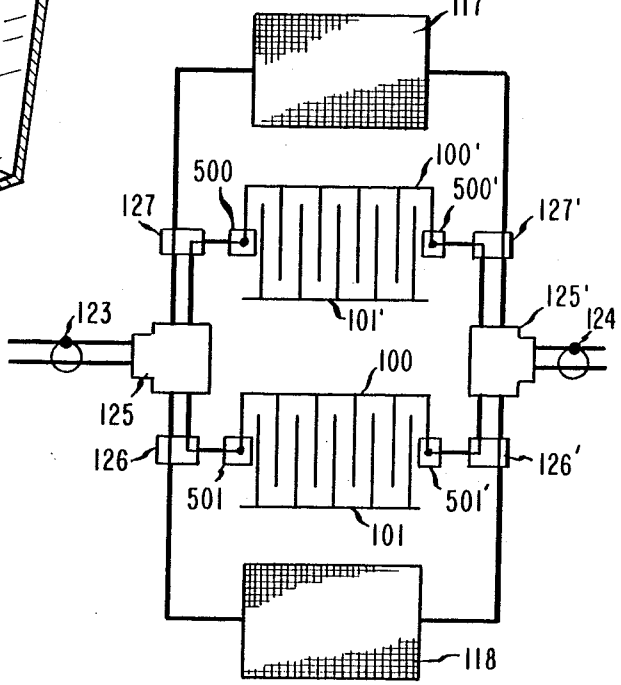
FIG. 18 is a wiring diagram illustrating the RF input and output connections to the slow-wave structure of FIG. 17.
Figure 17:
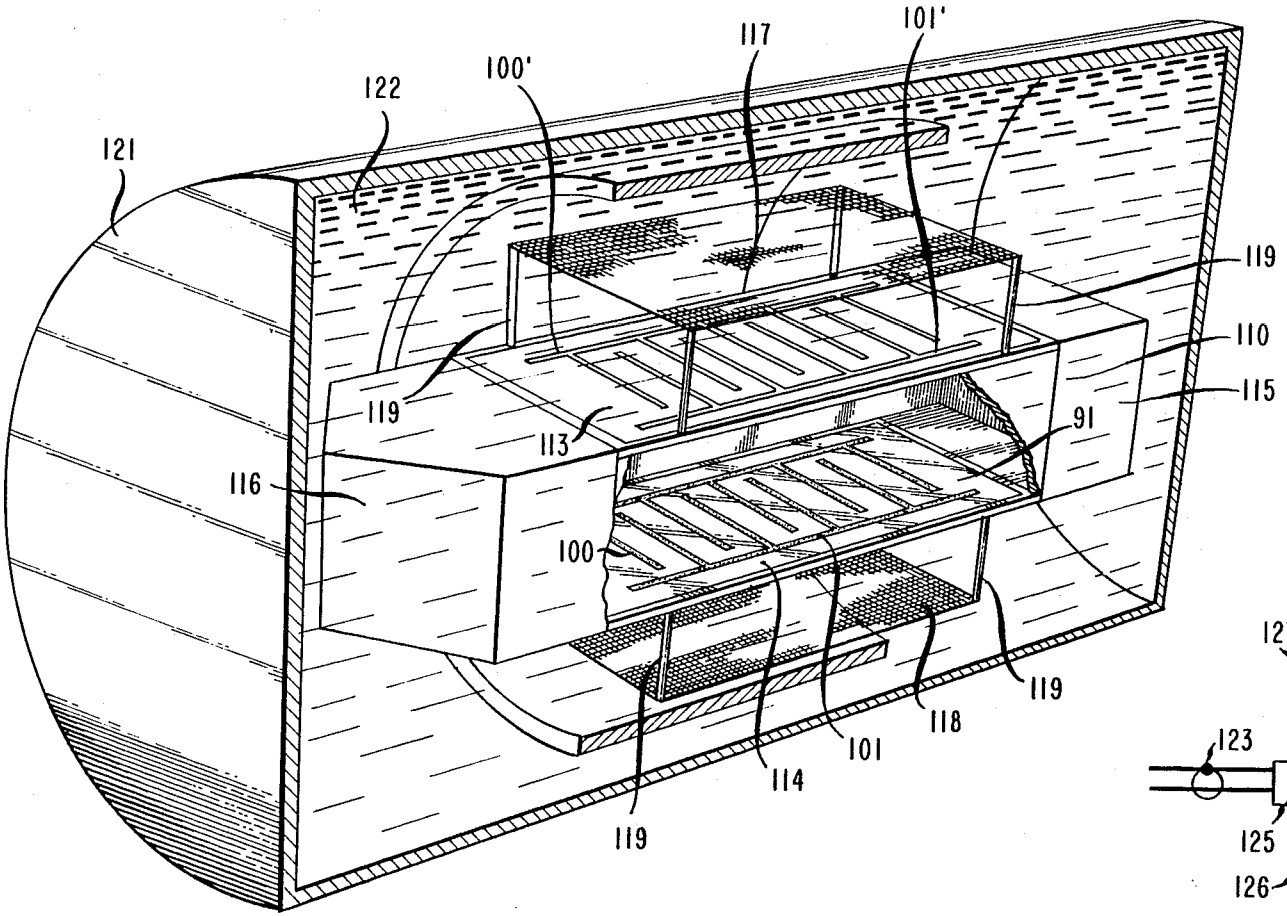
FIG. 17 is a partially schematic, partially cross sectional view of a traveling wave tube utilizing an interdigital slow-wave circuit according to the present invention.

FIGS. 17 and 18 illustrate another traveling-wave-tube device which employs, instead of the meanderline, an interdigital slow wave circuit, similar to that depicted in FIG. 14. FIG. 17 illustrates a device which in most respects is similar in operation and construction to the device of FIG. 15, and similar reference numerals are use for similar components throughout. However, meanderlines 92′ and 92 located on the top and bottom of box 110 in FIG. 15 have been replaced by the interdigital slow wave circuits 100 and 101 on the bottom side 114 of box 110 and interdigital circuits 100′ and 101′ on the upper side 113 of box 110.

FIG. 18 illustrates the input and output connection to the device of FIG. 17. Input conductor 123, which may be a coaxial cable, extends through container 122 to power divider 125. The input signal is equally divided at power divider 125 to RF connectors 126 and 127. RF connectors 127 and 126 have outer shields connected to ground planes 117 and 118 respectively. The center conductor of connector 127 divides at power divider 500 to both sides 100′ and 101′ of the interdigital slow wave circuit. Similarly, power divider 501 divides input to both sides 100 and 101 of the bottom slow wave circuit. Output power to output conductor 124 comes via power dividers 500′, 501′ and 125′ and connectors 127′ and 126′.

It is also possible to create a backward wave oscillator using meanderline or interdigital show wave circuits, as mentioned before.

Meanderline and interdigital slow wave circuits may also find application in injected beam crossed field amplifiers (IBCFA's). Such amplifiers are a class of microwave amplifiers characterized by interaction between a slow electromagnetic wave and an electron beam focused by perpendicular (i.e. crossed) electric and magnetic fields. (The devices discussed so far have featured parallel electric and magnetic fields). An example of the use of a superconducting ceramic meanderline in a crossed field amplifier is provided by FIG. 19. A discussion of the general principles of operation of crossed-field amplifiers is contained in: Espinosa et al., "Broadband Injected Beam Crossed Field Amplifiers" IEE Trans. Electron Devices, vol. ed-24, No. 1, January 1977, pp 13–21.

Figure 19:
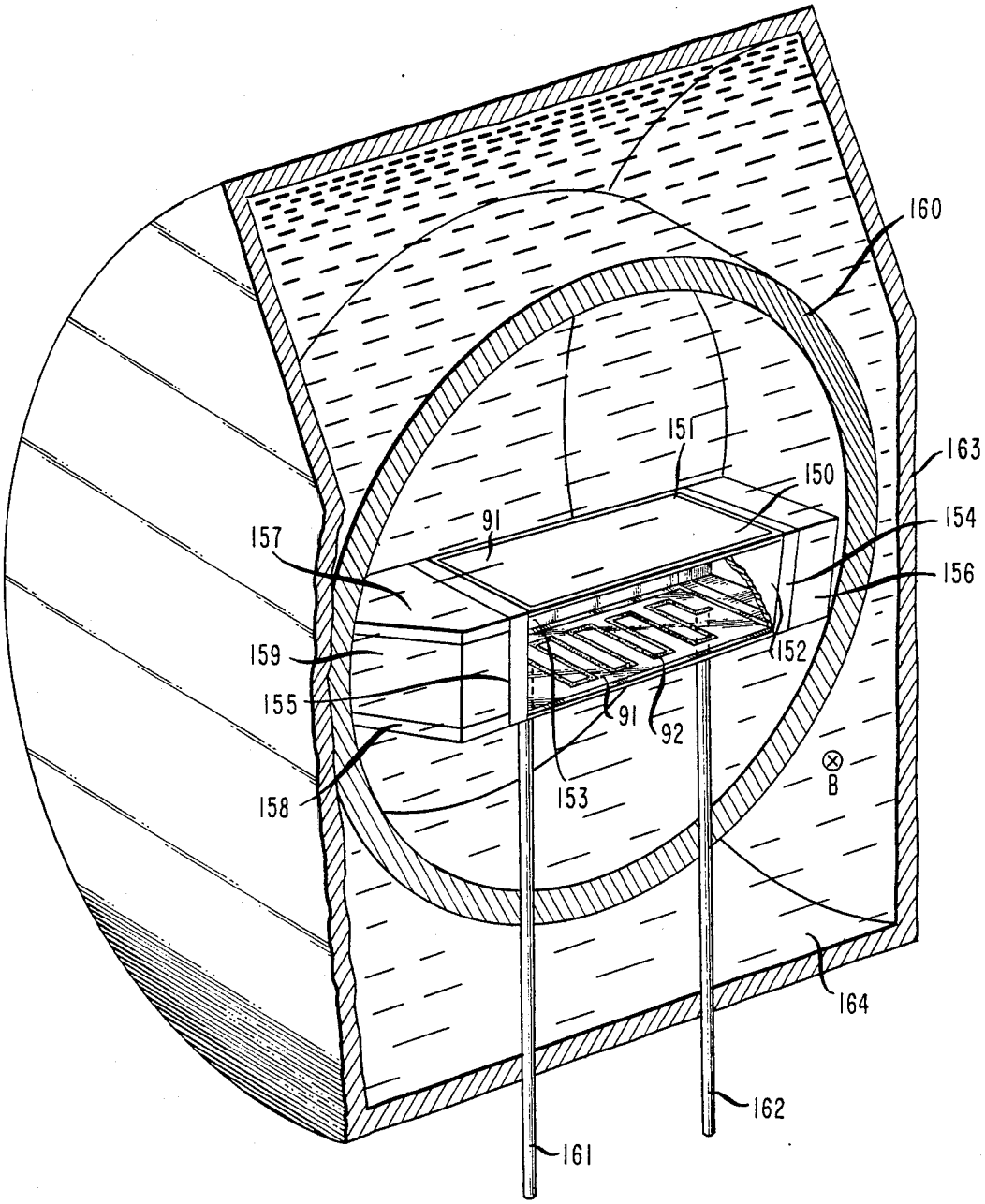
FIG. 19 is a partially schematic, partially cross sectional view of crossed field amplifier according to the present invention.

In FIG. 19 meanderline 92 and substrate 91 are formed by the processes already described. Vacuum housing 150 utilizes substrate 91 and meanderline 92 for its bottom. Top 151 of vacuum housing 150 is made from either metal or superconducting ceramic. Top 151 is the sole of the crossed-field amplifier. Front and rear sides 152 and 153 and left and right sides of box 110 are made from dielectric material. Insulators 155 and 156 serve to isolate sole 151 and collector 156 from vacuum housing 150. 0f course, the entire structure consisting of vacuum housing 150 together with a collector shown schematically as box 156 and container 159 which holds an electron gun shown schematically as box 158 and an anode positioned above the electron gun and shown schematically as box 157 must be fabricated vacuum tight. Permanent magnet 160 surrounds the entire aforedescribed structure. Magnet 160 is oriented to provide a magnetic field perpendicular to the plane of the figure. Coaxial RF connectors 161 and 162 serve respectively as input and output connectors. Power connections to the electron gun assembly and collector have been omitted for the sake of clarity. In operation, electrons emitted from electron gun 158 are attracted toward anode 157. However, the electrons do not strike anode 157 because they are routed by the magnetic field created by permanent magnet 160 into the region between meanderline 92 and sole 151. Electrons move under the influence of the magnetic and electric fields between meanderline 92 and sole 151. Interaction between the electron beam and the input RF signal on meander line 92 provides amplification. Container 163 holds coolant 164 which maintains meanderline 92 and sole 151 in a superconducting state.

Figure 21:
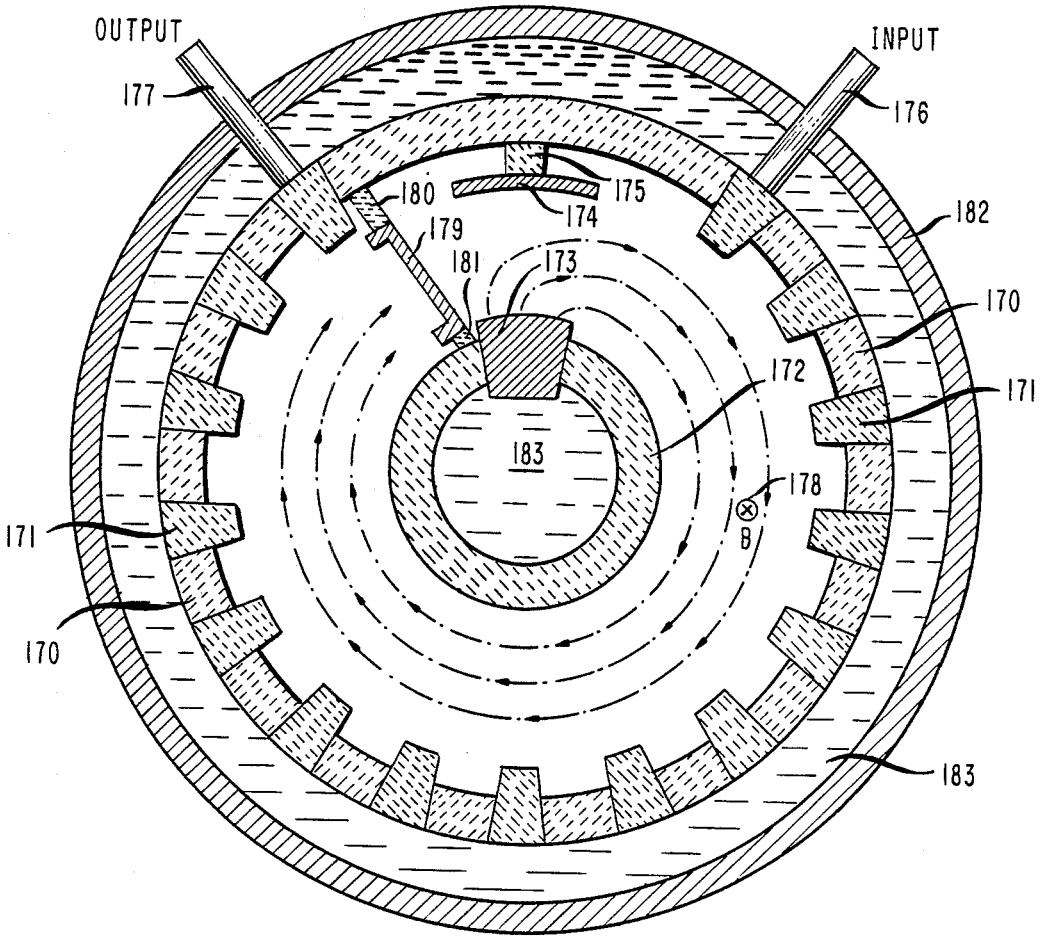
FIG. 21 is a partially schematic, partially cross sectional view of a crossed field amplifier utilizing the slow wave circuit of FIG. 20.
Figure 20:
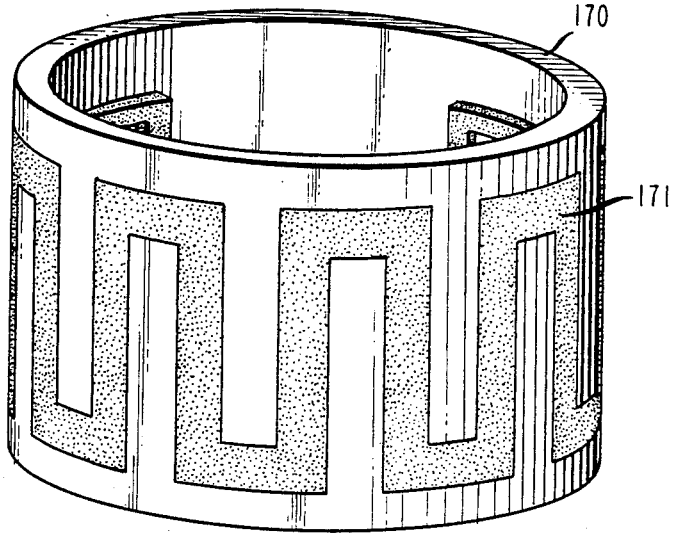
FIG. 20 is a perspective view of a cylindrical meanderline slow wave circuit according to the present invention.

FIGS. 20 and 21 illustrate a crossed-field amplifier in cylindrical format. FIG. 20 depicts a cylinder 170 of dielectric material with integral superconducting ceramic meanderline 171. Meanderline 171 penetrates to the interior of cylinder 170 in a manner akin to that illustrated in FIGS. 2–4.

FIG. 21 is a cross sectional view of a crossed field amplifier utilizing the superconducting ceramic RF slow wave circuit of FIG. 20. As can between from FIG. 21, meanderline 171 extends into the interior of cylinder 170. A generally cylindrical sole 172 is positioned within and concentric with dielectric cylinder 170. Electron gun 173 is located on the periphery of the sole 172. Anode 174 is attached to dielectric cylinder 170 by dielectric support 175. Anode 174 is positioned generally opposite electron gun 173. An electric field is established between anode 174 and electron gun 173 by power connections not illustrated for simplicity. RF input and output connectors 176 and 177 respectively are connected to the extreme ends of meander line 171. A magnetic field 178 is established perpendicular to the plane of the paper by permanent magnets not illustrated for simplicity. Collector 179 is positioned by dielectric supports 180 and 181 between sole 172 and dielectric cylinder 170. The entire device is immersed in a coolant bath 183 contained within container 182. Coolant 183 maintains the RF slow wave circut (meanderline 171) and sole 172 in the superconducting state. In operation, electrons ejected from electron gun 173 proceed in a generally clockwise fashion through the figure under the influence of perpendicular electric and magnetic fields. The electrons interact with the input signal introduced onto the RF slow wave circuit 171 via coupler 176. An amplified output signal obtained at coupler 177, while the spent electrons are collected at collector 179.

The foregoing cylindrical crossed-field amplifier design may also be implemented using a variety of other slow-wave circuits such as the interdigital slow wave circuit illustratd in FIG. 14.

The illustrations of all of the foregoing embodiments have included various power supplies and power dividers within the coolant envelopes. As mentioned before, it is possible to fabricate superconducting ceramics in wire-like shapes. Consequently, the transmission of power within the coolant envelope on superconducting carriers is easily achieved. However, should it prove desirable, or otherwise convenient, the power supplies, for example those illustrated in FIG. 1, may be removed from the coolant envelope at a possible loss of efficiency.

The devices illustrated in FIGS. 1–21 are amplifiers-i.e. two port devices. However, as mentioned before, it is also possible to use the inventive principles of the present invention to design a one-port device—i.e. an oscillator. Those familiar with the microwave power to tube art, are aware of the design similarities between the traveling wave tube and the backward wave oscillator. Specifically, the basic designs illustrated in FIGS. 1 (with helix modifications illustrated in FIGS. 5–7 and 9–10) together with the designs of FIGS. 15 and 17 can be modified to produce a backward wave oscillator simply by the elimination of the RF coupler located closest to the collector. Other modifications necessary to convert the basic traveling wave tube design to a backward wave oscillator are appreciated by those skilled in the microwave power tube art. For example, an electron gun assembly with a ring-shaped cathode for generating a hollow electron beam is often employed in backward wave oscillators. The use of a hollow electron beam traveling close to the slow-wave structure enhances the backward-wave interaction. In addition, it is desirable to be able to vary the voltage of the tube. Furthermore, different methods of loading the helix may be employed to create a backward wave oscillator. Nevertheless, each of the aforementioned embodiments may be utilized to create an effective backward wave oscillator with a lossless slow-wave circuit.

In general, operation of all of the disclosed devices is enhanced over their conventional counterparts because of their lossless slow-wave circuits. Some appreciation for the advantages to be gained from a lossless slow wave circuit can be gained from the following theoretical discussion which is principally based upon the analyses contained in: J. R. Pierce, "Traveling-Wave Tubes" D. Van Nostrand, Co. 1950. The classical small-signal theory given by Pierce and the parameters defined by Pierce are now part of the accepted vocabulary of the traveling wave tube industry. Pierce's treatise defines a velocity parameter b, and an attenuation parameter d, a gain parameter C, and a space charge parameter Q. The value of the gain parameter C is usually small (in the 0.01 to 0.1 range) and is related to the cube root of the ratio of the slow wave circuit impedance to the beam impedance. The velocity parameter, b, relates the electron velocity to the phase velocity of the electromagnetic wave on the slow-wave circuit (ignoring space-charge effects). If the value of b is zero, the wave and the electrons are perfectly synchronous. If b is greater than zero, the electrons are traveling faster than the wave and if b is less than zero, vice-versa. The attenuation parameter, d, is a real number which describes the exponential attenuation of the electromagnetic wave due to circuit losses. The space-charge parameter, Q, is a measure of the seriousness of space-charge effects in the tube.

FIG. 8.4, p. 123, of the Pierce treatise, which is incorporated herein by reference, is a graph which shows the gain B of the increasing wave in dB per wavelength as a function of the velocity parameter, b for various values of the attenuation parameter d. Examination of the graph shows that the gain of an increasing wave is greater when d equals zero (i.e. when there is no attenuation due to circuit losses—as happens for a superconducting slow wave circuit).

Similarly, FIG. 8.5, p. 124, of the Pierce treatise, which is hereby incorporated by reference, also shows that the gain of an increasing wave is greater for a lossless circuit.

The effects of a lossless circuit may also be analyzed according to the discussion on page 121 of the Pierce treatise, which is also incorporated herein by reference. Specifically, if the slow wave circuit is lossy, the voltage decays with distance as $$e^{-\beta_e cd} \text{ where } \beta_e = \frac{\omega}{\mu_o}$$

Therefore, the loss L in db/wavelenght is $L=20(2\pi)(\log_{10}e)$ or $L=54.5CD$ Consequently, if d equals zero, then L equals zero.

The Pierce text derives a fourth degree equation, which has four roots corresponding to four different propagation constants for the beam-circuit combination. These propagation characteristics are functions of a variety of parameters, including the respective impedances of the circuit and the beam, the beam velocity, the slow wave circuit loss, and space charge effects. If space charge effects are ignored, as a first approximation, four propagation constants are obtained from solution of the root equation. Three of these solutions represent forward-traveling waves (i.e. waves traveling toward the collector) and one solution represents a backward wave. The backward wave and one of the forward waves have unvarying amplitude. One of the forward waves has a decaying amplitude with distance, while the last forward wave has an increasing amplitude with distance. The wave of significance for traveling amplification, is, of course, the increasing wave. Pages 135–136 of Pierce's treatise are also hereby incorporated by reference. These pages express the gain of an increasing wave as $G=A+BCN$ dB FIG. 9.3, page 136 of Pierce's text is a graph illustrating the variation of A, (the initial loss in setting up the increasing wave) as a function of attenuation parameter d for b equals zero and Q equals zero. Examination of the graph of FIG. 9.3 confirms the conclusions expressed earlier, that A is minimum and the gain of the device is greatest for a lossless circuit.

Another advantage provided by the superconducting slow wave circuit of the present invention is that a lower tube voltage than otherwise possible may be used for high frequency operation. Pages 28–29 of the Pierce treatise are also hereby incorporated by reference FIG. 3.6, p. 29 of Pierce is a graph which roughly illustrates the variation of tube gain with frequency for both hollow beam and solid beam tubes. The graph illustrates (for both hollow beams and solid beams) that if the ratio of the radius of the beam to the radius of the helix is greater than 0.9 then larger $\gamma\alpha$ favors higher gain. This means that a lower voltage may be used for high frequency operation since $\gamma$ is approximately equal to $\beta$ or slow waves. The lrger the value of $\beta$ the lower the voltage operation. For a lossless circuit, a large $\gamma\alpha$ will give a large electric field in proximity to the electron beam.

Analysis of pages 225 and 238 of Pierces treatise, which are hereby incorporated by reference also illustrates that operation at lower-than-conventional voltages is feasible. Specifically, equation 22, page 238 provides an expression for the circuit impedance at radius a. The circuit impedance depends upon a modified Bessel function of the first kind. When the argument of the Bessel function increases, the amplitude of the longitudinal electric field also increases. Page 225 of Pierce's treatise, FIG. A1.1 illustrates the modified Bessel function of the first kind. The graph shows that the Bessel function increases monotonically with increasing argument. If slow-wave circuit is lossless one may build a large-length meanderline for low voltage operation without suffering amplitude loss on the slow wave circuit. The electron beam width may be made smaller than the circuit width and since the circuit is lossless, a long RF circuit path can be used for low voltage high impedance operation. The amplitude of the longitudinal electric field will not decay. So, low voltage operation is feasible at high frequencies.

Pages 17 and 18 of the Pierce treatise discusses the relationship between the electron velocity and the phase velocity of the circuit. As the electron velocity deviates from the phase velocity of the circuit, the gain begins to decrease. Equation 2.44, page 18 of Pierce's treatise expresses the allowable range of velocities. Thus, the allowable difference between the phase velocity of the circuit and the velocity of the electrons increases as the circuit impedance and beam current are increased and the voltage is decreased. Consequently, low voltage operation and higher frequencies not only provides higher gain, but also provides higher bandwidth.

Finally, as mentioned before, backward wave oscillators may also be constructed according to the teachings of the present invention. As might be expected, the performance of backward wave oscillators utilizing superconducting slow wave circuits is also enhanced. For a backward wave oscillator, the maximum rate of power transfer occurs in the central region of the slow wave circuit. It can be shown that if the total circuit loss is more than 6dB, then the output power is reduced to less than half. At the highest operating frequencies, the circuit losses are important and contribute to reduction and efficiency. A discussion of circuit losses and backward wave oscillators is contained in: A. H. W. Beck, "Space Charge Waves," Pergamon Press, New York, 1958, page 254, which is hereby incorporated by reference. Table 4, page 254 of the Beck treatise provide a summary on the calculated performance of backward oscillators. The table illustrates how important circuit loss becomes at high frequencies.

A disadvantage of conventional backward wave oscillators is that higher frequencies require higher voltages, while circuit coupling and normalized beam dimensions tend to remain constant. However, the input power level varies due to circuit dispersion (loss). For lossless circuit or a circuit in which the input power does not vary with frequency, the problem of large output variation with frequency is greatly reduced. Also, a lossless circuit means that "start oscillation" current level for the backward wave oscillator is reduced. Consequently, the device may be made more compact.

Since the lossless circuit is dispersionless ($^{dvg}/dw=0$), the phase velocity ( $V_p$ ) and group velocity ( $V_g$ ) of waves traveling on the circuit are esentially equal or independent or frequency. Consequently, for a lossless circuit, the bandwidth of the device is increased.

Thus, improved performance of the disclosed device is predicted by well-established theory.

The illustrative embodiments herein are merely a few of those possible variations which will occur to those skilled in the art while using the inventive principles used herein. Accordingly, numerous variations of invention are possible while staying within the spirit and scope of the invention is defined in the following claims and their legal equivalents.

What is claimed is:

1. A device comprising:

an electron gun for producing an electron beam;

a collector for collecting said electron beam;

a vacuum housing surrounding said electron beam and having an integral slow wave circuit, said circuit being made from superconducting ceramic material;

means for maintaining the temperature of said superconducting ceramic below its critical temperature;

means for extracting an output signal from said slow wave circuit;

means for creating a magnetic field within said vacuum housing so that interaction between said electron beam and said slow wave circuit produces said output signal.

2. The device of claim 1 further including:

means for connecting an input signal to said slow wave circuit.

3. The device of claim 1 wherein said slow wave circuit is a helix.

4. The device of claim 1 wherein said slow wave circuit is a ring bar circuit.

5. The device of claim 1 wherein said slow wave circuit is a bifilar helix.

6. The device of claim 1 wherein said slow wave circuit is a log periodic helix.

7. The device of claim 1 wherein said slow wave circuit is a meanderline.

8. The device of claim 1 wherein said slow wave circuit is an interdigital slow wave circuit.

9. The device of claim 1 wherein said slow wave circuit is a dual helix.

10. The device of claim 1 wherein said vacuum housing is cylindrical.

11. The device of claim 1 wherein said vacuum housing has a cylindrical midsection and two conical portions attached to the ends of said cylindrical midsection.

12. The device of claim 1 wherein said slow wave circuit protrudes into the interior of said vacuum housing.

13. The device of claim 1 wherein said superconducting ceramic is material having chemical formula: $RBa_2Cu_3O_{9-y}$ where R is selected from the group consisting of scandium, europium, gadolinium, dysprosium, holmium, erbium, ytterbium, yttrium, and lutetium and y is a number less than 9.

14. The device of claim 13 wherein y is $2.1\pm0.05$.

15. A microwave tube comprising:

an electron gun for producing an electron beam;

a collector for receiving said electron beam;

a vacuum housing between said electron gun and said collector, said vacuum housing a first dielectric portion and second superconducting ceramic helix portion, said dielectric portion and said helix portion being sealed together to form a unitary, intertwined, sealed enclosure, said helix having an inner surface and an outer surface, said inner surface being located within the interior of said vacuum housing for interaction with said electron beam;

means for maintaining the temperature of said superconducting helix below its critical temperature;

means for coupling signals onto and out of said helix;

means for creating a magnetic field within said vacuum housing so that interaction between said electron beam and said slow wave circuit produces an output signal.

16. A crossed field amplifier comprising:

an electron gun for producing an electron beam;

a collector for collecting said electron beam;

a vacuum housing having an integral slow wave circuit, said circuit being made from material with superconducting critical temperature above 77° K., and said vacuum housing also having a sole;

means for maintaining the temperature of said slow wave circuit below its said critical temperature;

means for producing an electric field;

means for producing a magnetic field perpendicular to said electric field so that interaction between said electron beam and said slow wave circuit produces an output signal.

17. A crossed field amplifier comprising:

a cylindrical vacuum housing having a first dielectric portion and a second superconductive meanderline portion, said dielectric portion and said meanderline portion being sealed together to form a unitary, intertwined enclosure, said meanderline having an inner surface and an outer surface, said inner surface being located within the interior of said vacuum housing;

an electron gun within said vacuum housing for producing an electron beam;

a cylindrical sole within said vacuum housing;

an anode within said vacuum housing;

means for producing an electric field between said electron gun and said sole;

means for producing a magnetic field perpendicular to said electric field so that interaction between said electron beam and said slow wave circuit produces output power.

* * * * *